US010334368B2

(12) United States Patent
Karl

(10) Patent No.: US 10,334,368 B2
(45) Date of Patent: Jun. 25, 2019

(54) ACOUSTIC SENSOR FOR TRANSMITTING AND RECEIVING ACOUSTIC SIGNALS

(71) Applicant: Robert Bosch GmbH, Stuttgart (DE)

(72) Inventor: Matthias Karl, Ettlingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/570,906

(22) PCT Filed: Apr. 8, 2016

(86) PCT No.: PCT/EP2016/057692
§ 371 (c)(1),
(2) Date: Oct. 31, 2017

(87) PCT Pub. No.: WO2016/184604
PCT Pub. Date: Nov. 24, 2016

(65) Prior Publication Data

US 2018/0295452 A1 Oct. 11, 2018

(30) Foreign Application Priority Data

May 20, 2015 (DE) ..... 10 2015 209 238

(51) Int. Cl.
*H04R 17/00* (2006.01)
*H04R 1/06* (2006.01)
(Continued)

(52) U.S. Cl.
CPC ..... *H04R 17/00* (2013.01); *H04R 1/06* (2013.01); *H04R 7/04* (2013.01); *H04R 31/006* (2013.01)

(58) Field of Classification Search
CPC . H04R 17/00; H04R 1/06; H04R 7/04; H04R 31/006
See application file for complete search history.

(56) References Cited

U.S. PATENT DOCUMENTS 5,923,115 A 7/1999 Mohr, III et al.
2001/0041837 A1 11/2001 Takeuchi et al.
(Continued)

FOREIGN PATENT DOCUMENTS

DE 3103357 A1 8/1982
DE 69330442 T2 5/2002
(Continued)

OTHER PUBLICATIONS

Translation of DE2013204478. KAMSTRUP AS. Jun. 4, 2013.*
(Continued)

*Primary Examiner* — Brian Ensey
(74) *Attorney, Agent, or Firm* — Norton Rose Fulbright US LLP; Gerard Messina

(57) ABSTRACT

An acoustic sensor including an electroacoustic transducer and an electrical conductor. The electroacoustic transducer includes a plate-shaped transducer element, which is configured to output an acoustic signal when it is excited by the electrical signal. The electroacoustic transducer furthermore includes a first contacting, which is situated on at least one of the surfaces of the plate-shaped transducer element in such a way that it has at least one portion which ends flush with the outer circumference of the first or second surface of the plate-shaped transducer element, or extends at least partially outside the outer circumference of the first or second surface of the plate-shaped transducer element. The electrical conductor includes a contact area in contact with an outer circumference of the first contacting, the contact area of the electrical conductor being situated in a plane defined by the first surface, outside an area which overlaps with the electroacoustic transducer.

10 Claims, 3 Drawing Sheets

(51) Int. Cl.
*H04R 7/04* (2006.01)
*H04R 31/00* (2006.01)

(56) References Cited

U.S. PATENT DOCUMENTS

| | | | | |
|---|---|---|---|---|
| 2003/0011282 | A1* | 1/2003 | Kishimoto ..... | H04R 1/06 310/324 |
| 2010/0241004 | A1 | 9/2010 | Jung et al. | |
| 2011/0075867 | A1 | 3/2011 | Chung et al. | |

FOREIGN PATENT DOCUMENTS

| | | | |
|---|---|---|---|
| DE | 20302713 | U1 | 4/2003 |
| DE | 102004022838 | A1 | 12/2005 |
| DE | 102006038597 | A1 | 4/2008 |
| DE | 102010008223 | A1 | 8/2011 |
| DE | 202013004478 | U1 | 6/2013 |
| JP | 200456352 | A | 2/2004 |
| JP | 2011146764 | A | 7/2011 |
| JP | 2012134336 | A | 7/2012 |
| JP | 2012205184 | A | 10/2012 |
| JP | 5153695 | B2 | 2/2013 |

OTHER PUBLICATIONS

International Search Report dated Jun. 28, 2016, of the corresponding International Application PCT/EP2016/057692 filed Apr. 8, 2016.

* cited by examiner

ACOUSTIC SENSOR FOR TRANSMITTING AND RECEIVING ACOUSTIC SIGNALS

FIELD

The present invention relates to an acoustic sensor.

BACKGROUND INFORMATION

A configuration of acoustic sensors, in particular in the field of ultrasonic sensor systems, is at times very complex and thus expensive. At times, piezoceramic disks are used as the electroacoustic transducer element in acoustic sensors. The piezoceramic disk is contacted via two lines, one line being welded to the piezoceramic disk on a top side of the piezoceramic disk and one line on the bottom side of the piezoceramic disk in order to electrically contact the disk. This mostly takes place before the piezoceramic disk is glued into a housing of the acoustic sensor, typically a pot-shaped structure made of aluminum. It is furthermore necessary to connect the two conductors to an associated activation electronic system, which is typically situated on a circuit board inside the acoustic sensor. It is very complex to position and contact all components of the acoustic sensor in the pot-shaped structure. A minimal overall size of the acoustic sensor is thus determined, which must be large enough to position all components and their contactings.

German Patent Application Nos. DE102004022838A1, DE102006038597A1 and DE3103357A1 describe acoustic sensors in which an electroacoustic transducer element rests on a circuit board.

SUMMARY

The acoustic sensor according to the present invention includes an electroacoustic transducer and an electrical conductor, which is configured to conduct an electrical signal. The electroacoustic transducer includes a plate-shaped transducer element, which is configured to output an acoustic signal when it is excited by the electrical signal and/or to output an electrical signal when it is excited by an acoustic signal. The plate-shaped transducer element includes a first surface, a second surface, which is situated in parallel to the first surface on a side of the plate-shaped transducer element situated opposite the first surface, and a third surface, which joins the first surface to the second surface of the transducer element. The electroacoustic transducer furthermore includes a first contacting, which is situated on at least one of the surfaces of the plate-shaped transducer element in such a way that it has at least one portion which ends flush with the outer circumference of the first or second surface of the plate-shaped transducer element, or extends at least partially outside the outer circumference of the first or second surface of the plate-shaped transducer element. The electrical conductor includes a contact area which is in contact with an outer circumference of the first contacting, the contact area of the electrical conductor being situated in a plane defined by the first surface, outside an area which overlaps with the electroacoustic transducer. As a result, a lateral contacting of the electroacoustic transducer is made possible.

In this way, a particularly flat configuration of an acoustic sensor is made possible. Due to the lateral contacting of the electroacoustic transducer, it is not necessary to guide the first contacting from the first surface to the second surface, or from the second surface to the first surface, whereby, in turn, it is avoided that the same potential is present on opposing sides of the plate-shaped transducer element, whereby an active area of the plate-shaped transducer element is increased. Moreover, a lateral stabilization of the electroacoustic transducer in the acoustic sensor takes place since the electroacoustic transducer is held in position by the electrical conductor. The first contacting serves as a lateral stop during a positioning of the electroacoustic transducer.

Preferred refinements of the present invention are described herein.

It is advantageous when the electrical conductor is a strip conductor. A strip conductor is an electrical conductor which is applied onto an associated surface and extends along this surface. In this way, a particularly flat configuration of the acoustic sensor is made possible. Additional insulation of the electrical conductor may be dispensed with.

It is also advantageous when the acoustic sensor includes a diaphragm, and the electroacoustic transducer is situated on a surface of the diaphragm. This enables a free oscillation of the plate-shaped transducer element, this at the same time being supported by the diaphragm to prevent the plate-shaped transducer element from breaking.

It is also advantageous when the electrical conductor is situated on the diaphragm. In this way, the electrical conductor oscillates with the diaphragm, and reliable contacting between the electrical conductor and the electroacoustic transducer is ensured.

It is furthermore advantageous when the acoustic sensor includes a circuit board. This allows an electronic system of the acoustic sensor to be easily and reliably situated.

It is furthermore advantageous when the electrical conductor is situated on the circuit board. This enables a particularly simple configuration of the acoustic sensor, in particular an electrical connection between the electroacoustic transducer and an associated electronic system on the circuit board being ensured.

It is also advantageous when the electroacoustic transducer rests on the circuit board. In this way, a correct arrangement of the electroacoustic transducer inside the acoustic sensor may be easily achieved. Moreover, a particularly flat configuration of the acoustic sensor is made possible.

It is advantageous when the circuit board is situated in parallel to the plane defined by the first surface and includes at least one breakthrough, which is situated within an area of the circuit board which overlaps with the electroacoustic transducer. In this way, a free oscillation of the plate-shaped transducer element is made possible. An attenuation of the acoustic signal by the circuit board is minimized, and the sensitivity or transmission strength of the acoustic sensor is thus optimized.

It is also advantageous when the circuit board includes a circuit board surface having a depression, and the electroacoustic transducer is at least partially situated inside this depression. In this way, a particularly flat configuration of the acoustic sensor is made possible. Moreover, a particularly efficient stabilization of the electroacoustic transducer takes place in the acoustic sensor.

It is furthermore advantageous when the first contacting extends across the entire first surface of the electroacoustic transducer, and the electroacoustic transducer is enclosed by an electrically conductive layer, which extends in the plane defined by the first surface. In this way, a closed electrically conductive surface may be created, which protects the acoustic sensor against electromagnetic irradiation.

It is also advantageous when the contact area is situated in a shared plane with the plate-shaped transducer element. This enables a particularly flat configuration of the acoustic sensor.

The acoustic sensor is in particular an acoustic sensor which is configured to emit and/or to receive an acoustic signal in a frequency range under 200 kHz, in particular under 50 kHz. The acoustic sensor is in particular an ultrasonic sensor.

BRIEF DESCRIPTION OF THE DRAWINGS

Exemplary embodiments of the present invention are described hereafter in greater detail with reference to the figures.

DETAILED DESCRIPTION OF EXAMPLE EMBODIMENTS

Figure 1:
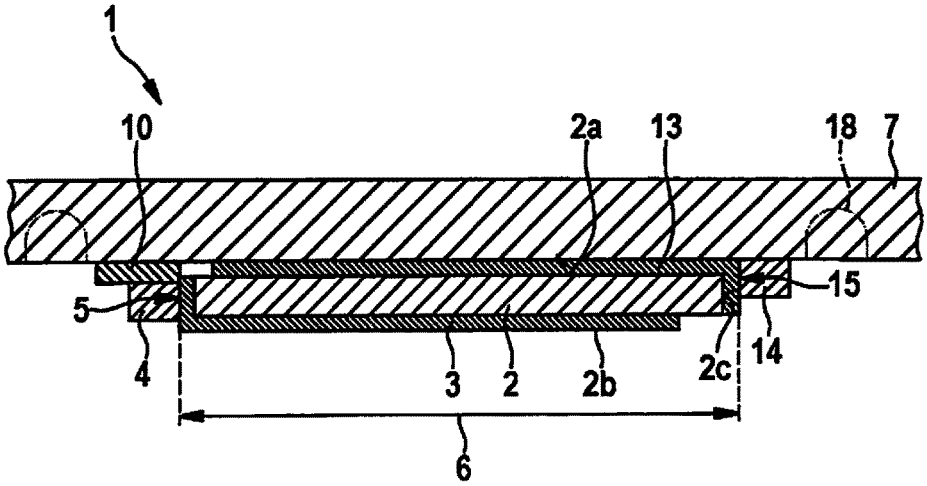
FIG. 1 shows a cross section through an acoustic sensor according to a first specific embodiment of the present invention.

FIG. 1 shows an acoustic sensor 1 according to a first specific embodiment of the present invention.

Acoustic sensor 1 includes a plate-shaped transducer element 2, which is configured to output an acoustic signal when it is excited by an electrical signal, and to output an electrical signal when it is excited by an acoustic signal. Plate-shaped transducer element 2 is a circular disk-shaped piezo element in this first specific embodiment. Plate-shaped transducer element 2 includes a first surface 2*a*, a second surface 2*b*, which is situated in parallel to first surface 2*a* on a side of the plate-shaped transducer element situated opposite first surface 2*a*, and a third surface 2*c*, which joins first surface 2*a* to second surface 2*b* of transducer element 2. In this first specific embodiment, first surface 2*a* is a circular surface, which is situated at the top in the arrangement of plate-shaped transducer element 2 shown in FIG. 1. Second surface 2*b* is a circular surface of electroacoustic transducer 2, which is situated at the bottom in the arrangement of plate-shaped transducer element 2 shown in FIG. 1. The third surface of transducer element 2 is the non-circular surface of the circular disk-shaped, plate-shaped transducer element 2.

A first contacting 3 and a second contacting 13 are situated on plate-shaped transducer element 2. First contacting 3 and second contacting 13 are formed of an electrically conductive material.

First contacting 3 extends across a portion of second surface 2*b* and a portion of third surface 2*c*. First contacting 3 covers the majority of second surface 2*b*. First contacting 3 is thus situated on second surface 2*b* and third surface 2*c* of plate-shaped transducer element 2. Since first contacting 3 extends beyond second surface 2*b*, i.e., includes a portion which in FIG. 1 is situated to the left next to plate-shaped transducer element 2, first contacting 3 extends partially outside the outer circumference of first and second surfaces 2*a*, 2*b*.

Second contacting 13 extends across a portion of first surface 2*a* and a further portion of third surface 2*c*, which is different from the portion of third surface 2*c* in which first contacting 3 is situated. Second contacting 13 covers the majority of first surface 2*a*. Second contacting 13 is thus situated on first surface 2*a* and third surface 2*c* of plate-shaped transducer element 2. Since second contacting 13 extends beyond second surface 2*b*, i.e., includes a portion which in FIG. 1 is situated to the right next to plate-shaped transducer element 2, second contacting 13 extends partially outside the outer circumference of first and second surfaces 2*a*, 2*b*.

Plate-shaped transducer element 2, first contacting 3 and second contacting 13 together form an electroacoustic transducer. The electroacoustic transducer extends in a plane defined by first surface 2*a* across an area 6.

Acoustic sensor 1 includes a diaphragm 7. The electroacoustic transducer is situated on a surface of diaphragm 7. Diaphragm 7 extends in parallel to first surface 2*a* of plate-shaped transducer element 2. With a surface facing away from plate-shaped transducer element 2, second contacting 13 is in contact with diaphragm 7. The electroacoustic transducer is glued to diaphragm 7. A first strip conductor 4 and a second strip conductor 14 extend along a surface of diaphragm 7 which is situated on the side of the electroacoustic transducer.

An insulation 10 is situated between first strip conductor 4 and diaphragm 7. First strip conductor 4 includes a first contact area 5, which is in contact with an outer circumference of electroacoustic transducer 3, which at this point is formed by first contacting 3. It is thus made possible that an electrical signal flows via first strip conductor 4 and first contacting 3 to plate-shaped transducer element 2. Considering a plane defined by first surface 2*a*, which in FIG. 1 extends from left to right, first contact area 5 of first strip conductor 4 is situated outside area 6 which overlaps with the electroacoustic transducer. To enable a contact between first contacting 3 and first strip conductor 4, first contact area 5, however, overlaps with the electroacoustic transducer in a direction which is situated perpendicularly to the first surface. According to FIG. 1, the electroacoustic transducer is thus contacted laterally, here from the left.

No insulation 10 is situated between second strip conductor 14 and diaphragm 7. Second strip conductor 14 includes a second contact area 15, which is in contact with an outer circumference of electroacoustic transducer 3, which at this point is formed by second contacting 13. It is thus made possible that an electrical signal flows via second strip conductor 14 and second contacting 13 to plate-shaped transducer element 2. Considering the plane defined by first surface 2*a*, second contact area 15 of second strip conductor 14 is situated outside area 6 which overlaps with the electroacoustic transducer. To enable a contact between second contacting 13 and second strip conductor 14, second contact area 15, however, overlaps with the electroacoustic transducer in a direction which is situated perpendicularly to first surface 2*a*. According to FIG. 1, the electroacoustic transducer is thus contacted laterally, here from the right.

First strip conductor 4 and second strip conductor 14 are coupled to an electronic system, with the aid of which an electrical signal may be generated which excites plate-shaped transducer element 2 to carry out an oscillation during a transmission phase. Moreover, the electrical circuit is configured to process an electrical signal which is caused by plate-shaped transducer element 2 during a reception phase when it is excited by an acoustic signal to carry out an oscillation.

Figure 2:
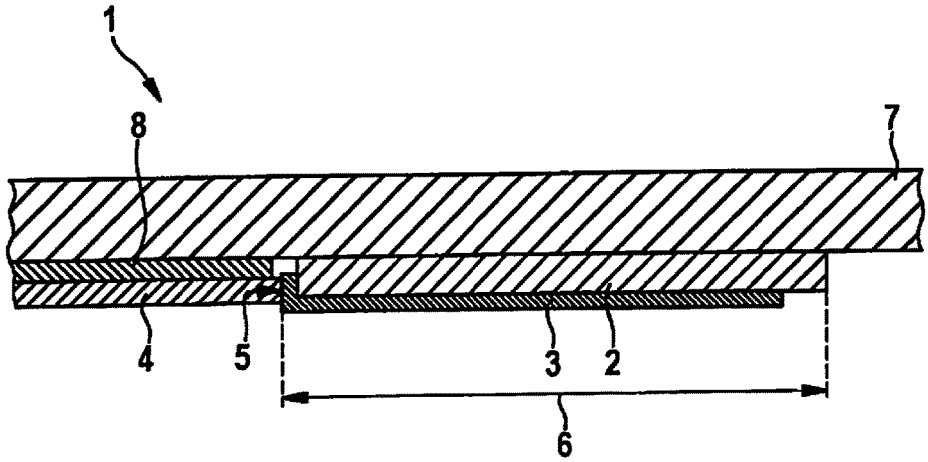
FIG. 2 shows a cross section through an acoustic sensor according to a second specific embodiment of the present invention.

FIG. 2 shows an acoustic sensor 1 according to a second specific embodiment of the present invention. Electroacoustic transducer 1 of the second specific embodiment corresponds to electroacoustic transducer 1 of the first specific embodiment, the electroacoustic transducer of the second specific embodiment including only plate-shaped transducer element 2 and first contacting 3, but not second contacting 13. The electroacoustic transducer is also situated on diaphragm 7 in the second specific embodiment. First surface 2*a* of plate-shaped transducer element 2 is in contact with diaphragm 7 across the full surface area. Diaphragm 7 is electrically conductive or includes a conductive coating on the side of the electroacoustic transducer.

Furthermore, a circuit board 8 is situated along the surface of diaphragm 7 which is situated on the side of the electroacoustic transducer. The area of the surface of diaphragm 7 in which circuit board 8 is situated does not overlap with an area of the surface of diaphragm 7 in which the electroacoustic transducer is situated. Circuit board 8 is thus situated in a plane defined by first surface 2*a*, outside area 6 which overlaps with the electroacoustic transducer. Circuit board 8 has a thickness that is less than a thickness of the electroacoustic transducer. First strip conductor 4 is situated on circuit board 8. First strip conductor 4 is situated on a side of circuit board 8 facing away from diaphragm 7. First strip conductor 4 extends up to an edge area of circuit board 8 situated on the side of the electroacoustic transducer and ends flush with circuit board 8. Circuit board 8 and thus first contact area 5 of first strip conductor 4 directly abut first contacting 3. Since first contacting 3 and first strip conductor 4 directly abut one another, an electrical contact exists between these elements.

The excitation of plate-shaped transducer element 2 or a forwarding of an electrical signal when plate-shaped transducer element 2 is excited by an acoustic signal takes place in accordance with the first specific embodiment of the present invention. However, since the electroacoustic transducer does not include a second contacting, the task of second contacting 13 is assumed by electrically conductive diaphragm 7 or the electrically conductive coating of diaphragm 7.

Figure 3:
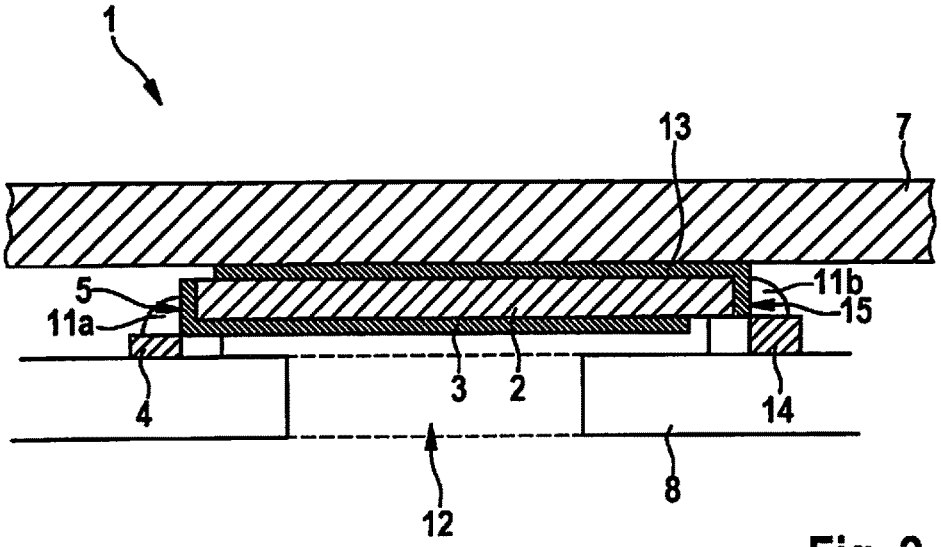
FIG. 3 shows a cross section through an acoustic sensor according to a third specific embodiment of the present invention.

FIG. 3 shows a cross section through an acoustic sensor 1 according to a third specific embodiment of the present invention. The electroacoustic transducer corresponds to the electroacoustic transducer of the first specific embodiment. The electroacoustic transducer is situated on diaphragm 7 according to the first specific embodiment.

In this third specific embodiment, circuit board 8 is also situated in parallel to first surface 2*a* of plate-shaped transducer element 2, which, however is situated in a plane behind the electroacoustic transducer, as viewed from diaphragm 7. First strip conductor 4 and second strip conductor 14 are situated on circuit board 8. First strip conductor 4 and second strip conductor 14 are situated on a side of circuit board 8 facing the electroacoustic transducer. The electroacoustic transducer rests with first contacting 3 on first strip conductor 4. The electroacoustic transducer furthermore rests with a portion of plate-shaped transducer element 2, which is not covered by first contacting 3, on second strip conductor 14. In this third specific embodiment as well, a lateral contacting of the electroacoustic transducer takes place. This takes place via a first solder spot 11*a*, which in this third specific embodiment of the present invention forms electrical conductor 4 which is in contact with the outer circumference of first contacting 3. Correspondingly, second solder spot 11*b* forms a second electrical conductor which is in contact with an outer circumference of second contacting 13.

Circuit board 8 furthermore includes a through-opening 12, which connects a side of circuit board 8 facing diaphragm 7 to a side of circuit board 8 facing away from diaphragm 7. Through-opening 12 is situated in an area of circuit board 8 which is covered by the electroacoustic transducer, as viewed from diaphragm 7. In this way, a free oscillation of the electroacoustic transducer together with diaphragm 7 is made possible.

Figure 4:
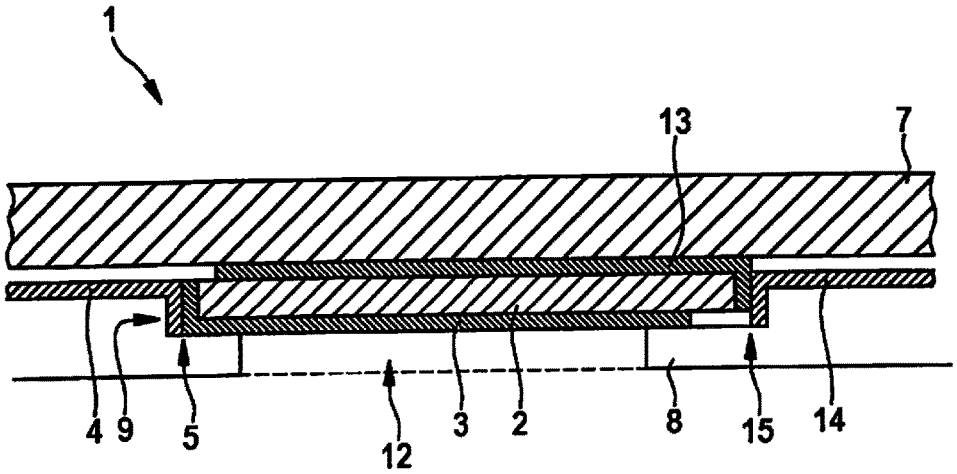
FIG. 4 shows a cross section through an acoustic sensor according to a fourth specific embodiment of the present invention.

FIG. 4 shows a cross section through an acoustic sensor 1 according to a fourth specific embodiment of the present invention. The electroacoustic transducer of the fourth specific embodiment corresponds to the electroacoustic transducer of the first and third specific embodiments. The electroacoustic transducer of the fourth specific embodiment is situated on diaphragm 7, corresponding to the electroacoustic transducer of the first and third specific embodiments.

Acoustic sensor 1 according to the fourth specific embodiment also includes a circuit board 8. However, circuit board 8 in this fourth specific embodiment includes a depression, and the electroacoustic transducer is situated at least partially in this depression. The electrical conductor according to the present invention, which is in contact with the outer circumference of first contacting 3, is formed by first strip conductor 4, as in the first and second specific embodiments.

Circuit board 8 is situated in parallel to diaphragm 7 and rests on the same side of diaphragm 7 as the electroacoustic transducer. A surface of circuit board 8, which is situated on the side of diaphragm 7, is recessed in the area in which the electroacoustic transducer is situated. Circuit board 8 is situated in such a way that the electroacoustic transducer is situated in depression 9 with its side facing away from diaphragm 7. The electroacoustic transducer is recessed completely or only partially in circuit board 8.

First strip conductor 4 extends outside the depression on the surface of circuit board 8 and follows surface of the circuit board 8 into depression 9. Strip conductor 4 ends at a point at which it reaches the bottom of the depression. In this way, only an edge area of the depression is covered by strip conductor 4. On an opposing side of depression 9, second strip conductor 14 is situated correspondingly. It should be noted that depression 9 is dimensioned in such a way that, in addition to the electroacoustic transducer, there is also room for the contact areas of first strip conductor 4 and second strip conductor 14. The electroacoustic transducer is situated in depression 9 in such a way that first contacting 3 is in contact with first strip conductor 4, and second contacting 13 is in contact with second strip conductor 14. Similarly to the third specific embodiment, circuit board 8 includes a breakthrough which is covered by the electroacoustic transducer, as viewed from diaphragm 7.

First contact area 5 and second contact area 15 are thus situated in a shared plane with plate-shaped transducer element 2.

Figure 5:
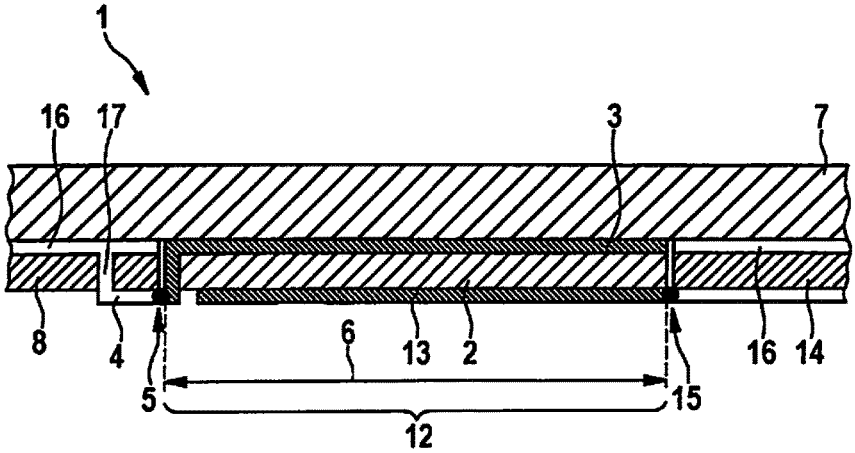
FIG. 5 shows a cross section through an acoustic sensor according to a fifth specific embodiment of the present invention.

FIG. 5 shows an acoustic sensor 1 according to a fifth specific embodiment of the present invention. Plate-shaped transducer element 2 of the fifth specific embodiment corresponds to plate-shaped transducer element 2 of the first through fourth specific embodiments.

First contacting 3 and second contacting 13 are situated on plate-shaped transducer element 2. In this fifth specific embodiment, first contacting 3 extends across the entire first surface 2*a* and a portion of third surface 2*c*. Second contacting 13 extends across a portion of second surface 2*b* and a further portion of third surface 2*c*, which is different from the portion of third surface 2*c* in which first contacting 13 is situated. First contacting 3 is not in contact with second contacting 13.

Plate-shaped transducer element 2, first contacting 3 and second contacting 13 together form an electroacoustic transducer. The electroacoustic transducer extends in a plane defined by first surface 2*a* across an area 6. The electroacoustic transducer is situated on the surface of diaphragm 7. With a surface facing away from plate-shaped transducer element 2, first contacting 3 is in contact with diaphragm 7.

In this fifth specific embodiment, acoustic sensor 1 includes a circuit board 8, which is situated in a shared plane with plate-shaped transducer element 2. For this purpose, circuit board 8 includes a through-opening 12 between its side situated on the side of diaphragm 7 and its side facing away from diaphragm 7. Through-opening 12 is designed according to the circumference of electroacoustic transducer 2, and the electroacoustic transducer is situated in this through-opening 12 accurately fitting or with little play. Circuit board 8 thus extends outside area 6.

The side of circuit board 8 situated on the side of diaphragm 7 is completely covered with an electrically conductive layer. First strip conductor 4 is situated on circuit board 8. First strip conductor 4 is situated on a side of circuit board 8 facing away from diaphragm 7. With the aid of a via 17, an electrically conductive connection exists between first strip conductor 4 and electrically conductive layer 16. First strip conductor 4 extends up to an edge area of circuit board 8 situated on the side of the electroacoustic transducer and ends flush with circuit board 8. Circuit board 8 and thus first strip conductor 4 directly abut first contacting 3. First contacting 3 and first strip conductor 4 are soldered to one another at this point. An electrical contact thus exists in this specific embodiment between first contacting 3 and first strip conductor 4 in contact area 5.

Furthermore, second strip conductor 14 is situated on circuit board 8. Second strip conductor 14 is also situated on a side of circuit board 8 facing away from diaphragm 7. Second strip conductor 14 extends up to an edge area of circuit board 8 situated on the side of the electroacoustic transducer and ends flush with circuit board 8. Circuit board 8 and second strip conductor 14 directly abut second contacting 13. Second contacting 13 and second strip conductor 14 are soldered to one another at this point. An electrical contact thus exists in this specific embodiment between second contacting 13 and second strip conductor 14 in contact area 15.

It is incidental that electrically conductive layer 16, together with first contacting 3, results in a continuous electrically conductive area which extends along diaphragm 7. A minor gap may occur only in the area in which the electroacoustic transducer abuts circuit board 8, since first contact area 5 and second contact area 15 are situated on a side of circuit board 8 facing away from diaphragm 7. In this way, a protective layer is created, which protects acoustic sensor 1 against electromagnetic irradiation which is irradiated into it from the side of diaphragm 7. It is particularly advantageous when the first strip conductor, together with electrically conductive layer 16, is connected to a ground potential.

In all specific embodiments, diaphragm 7 may optionally include a taper 18, which extends across a surface of diaphragm 7 in such a way that it surrounds the electroacoustic transducer. In this way, an attenuation of the diaphragm is decreased, and an efficiency of acoustic sensor 1 is enhanced. It is pointed out that it is also possible to implement other joints instead of the soldered joints described in the specific embodiments. Exemplary alternatives are bonded or welded joints, for example.

What is claimed is:

1. An acoustic sensor, comprising:

an electroacoustic transducer, including:

a plate-shaped transducer element, which is configured at least one of: (i) to output an acoustic signal when it is excited by an electrical signal, and (ii) to output an electrical signal when it is excited by an acoustic signal, the plate shaped transducer element including:

a first surface, a second surface, which is situated in parallel to the first surface on a side of the plate-shaped transducer element situated opposite the first surface, and a third surface, which joins the first surface to the second surface of the transducer element;

a first contacting, which is situated on at least one of the first, second and third surfaces of the plate-shaped transducer element in such a way that it has at least one portion which one of: (i) ends flush with an outer circumference of one of the first or second surface of the plate-shaped transducer element, or (ii) extends at least partially outside the outer circumference of one of the first or second surface of the plate-shaped transducer element; and an electrical conductor which is configured to conduct an electrical signal, the electrical conductor including a contact area which is in contact with an outer circumference of the first contacting, the contact area of the electrical conductor being situated in a plane defined by the first surface, outside an area which overlaps with the electroacoustic transducer, wherein the electrical conductor is a strip conductor, wherein the acoustic sensor includes a diaphragm, wherein the strip conductor has a surface that extends entirely along a surface of the diaphragm.

2. The acoustic sensor as recited in claim 1, wherein the electroacoustic transducer is situated on a surface of the diaphragm.

3. The acoustic sensor as recited in claim 2, wherein the electrical conductor is situated on the diaphragm.

4. The acoustic sensor as recited in claim 1, wherein the acoustic sensor includes a circuit board.

5. The acoustic sensor as recited in claim 4, wherein the electrical conductor is situated on the circuit board.

6. The acoustic sensor as recited in claim 4, wherein the electroacoustic transducer rests on the circuit board.

7. The acoustic sensor as recited in claim 4, wherein the circuit board is situated in parallel to a plane defined by the first surface and includes at least one through-opening, which is situated within an area of the circuit board which overlaps with the electroacoustic transducer.

8. The acoustic sensor as recited in claim 4, wherein the circuit board includes a circuit board surface having a depression, and the electroacoustic transducer is at least partially situated inside the depression.

9. The acoustic sensor as recited in claim 1, wherein the first contacting extends across the entire first surface of the electroacoustic transducer, and the electroacoustic transducer is enclosed by an electrically conductive layer, which extends in the plane defined by the first surface.

10. The acoustic sensor as recited in claim 1, wherein the contact area is situated in a shared plane with the plate-shaped transducer element.

* * * * *